US008414326B2

(12) United States Patent
Bowman

(10) Patent No.: US 8,414,326 B2
(45) Date of Patent: Apr. 9, 2013

(54) INTERNAL COAXIAL CABLE CONNECTOR INTEGRATED CIRCUIT AND METHOD OF USE THEREOF

(75) Inventor: Robert Bowman, Fairport, NY (US)

(73) Assignee: Rochester Institute of Technology, Rochester, NY (US)

( * ) Notice: Subject to any disclaimer, the term of this patent is extended or adjusted under 35 U.S.C. 154(b) by 156 days.

(21) Appl. No.: 12/961,555

(22) Filed: Dec. 7, 2010

(65) Prior Publication Data

US 2011/0077884 A1 Mar. 31, 2011

Related U.S. Application Data

(63) Continuation-in-part of application No. 12/271,999, filed on Nov. 17, 2008, now Pat. No. 7,850,482.

(51) Int. Cl.
*H01R 3/00* (2006.01)

(52) U.S. Cl.
USPC ..... 439/488; 439/620.03; 439/913

(58) Field of Classification Search ..... 439/489, 439/913, 488, 620.03; 324/126; 340/656, 340/687
See application file for complete search history.

(56) References Cited

U.S. PATENT DOCUMENTS

| | | | | |
|---|---|---|---|---|
| 2,640,118 | A | 5/1953 | Werner | |
| 3,196,424 | A | 7/1965 | Hardesty et al. | |
| 3,388,590 | A | 6/1968 | Bond | |
| 3,396,339 | A * | 8/1968 | Miram | 324/126 |
| 3,524,133 | A * | 8/1970 | Arndt | 324/102 |
| 3,657,650 | A * | 4/1972 | Arndt | 324/126 |
| 3,686,623 | A | 8/1972 | Nijman | |
| 3,768,089 | A | 10/1973 | Costanzo | |
| 3,808,580 | A | 4/1974 | Johnson | |
| 3,945,704 | A | 3/1976 | Kraus et al. | |
| 3,960,428 | A | 6/1976 | Naus et al. | |
| 3,961,330 | A | 6/1976 | Davis | |
| 4,034,289 | A * | 7/1977 | Rozylowicz et al. | 714/47.1 |
| 4,084,875 | A | 4/1978 | Yamamoto | |
| 4,240,445 | A | 12/1980 | Iskander et al. | |

(Continued)

FOREIGN PATENT DOCUMENTS

EP 0527599 A1 2/1993

OTHER PUBLICATIONS

U.S. Appl. No. 12/960,592, filed Dec. 6, 2010; Confirmation No. 7529.

(Continued)

*Primary Examiner* — Neil Abrams
(74) *Attorney, Agent, or Firm* — Schmeiser, Olsen & Watts LLP

(57) ABSTRACT

A structure is provided. The structure includes a signal retrieval circuit formed within a disk located within a coaxial cable connector. The signal retrieval circuit is located in a position that is external to a signal path of an electrical signal flowing through the coaxial cable connector. The signal retrieval circuit is configured to extract an energy signal from the electrical signal flowing through the coaxial cable connector. The energy signal is configured to apply power to an electrical device located within the coaxial cable connector. The sensing circuit is configured to sense physical parameter such as condition of the RF electrical signal flowing through the connector or presence of moisture in the connector. The structure may include an integrated circuit configured to convert the parameter signal into a data acquisition signal readable by the integrated circuit.

25 Claims, 12 Drawing Sheets

U.S. PATENT DOCUMENTS 4,421,377 A 12/1983 Spinner
4,489,419 A 12/1984 Wang
4,758,459 A 7/1988 Mehta
4,777,381 A * 10/1988 Fernandes ..... 307/64
4,898,759 A 2/1990 Hoover et al.
4,911,655 A 3/1990 Pinyan et al.
4,915,639 A 4/1990 Cohn et al.
4,927,382 A 5/1990 Huber
5,059,948 A 10/1991 Desmeules
5,076,797 A 12/1991 Moulton
5,169,329 A 12/1992 Taguchi
5,194,016 A 3/1993 Hatagishi et al.
5,217,391 A 6/1993 Fisher, Jr.
5,225,816 A 7/1993 Lebby et al.
5,278,525 A 1/1994 Palinkas
5,278,571 A 1/1994 Helfrick
5,345,520 A 9/1994 Grile
5,355,883 A 10/1994 Ascher
5,462,450 A 10/1995 Kodama
5,490,033 A 2/1996 Cronin
5,491,315 A 2/1996 McMills et al.
5,518,420 A 5/1996 Pitschi
5,561,900 A 10/1996 Hosler, Sr.
5,565,783 A * 10/1996 Lau et al. ..... 324/522
5,565,784 A 10/1996 DeRenne
5,620,330 A 4/1997 Pizon
5,664,962 A 9/1997 Noda
5,892,430 A * 4/1999 Wiesman et al. ..... 340/538.16
5,904,578 A 5/1999 Kubota et al.
5,924,889 A 7/1999 Wang
6,034,521 A * 3/2000 Eckardt ..... 324/96
6,041,644 A 3/2000 Harde
6,093,043 A 7/2000 Gray et al.
6,134,774 A 10/2000 Williams et al.
6,193,568 B1 2/2001 Dorr
6,236,551 B1 5/2001 Jones et al.
6,243,654 B1 6/2001 Johnson et al.
6,362,709 B1 3/2002 Paxman et al.
6,414,636 B1 7/2002 Godard et al.
6,490,168 B1 12/2002 Rochowicz et al.
6,549,017 B2 4/2003 Coffeen
6,570,373 B1 5/2003 Viola
6,618,515 B2 9/2003 Kimura et al.
6,646,447 B2 11/2003 Cern et al.
6,650,885 B2 11/2003 Anderson et al.
6,755,681 B2 6/2004 Chen
6,783,389 B1 8/2004 Lee
6,859,029 B2 * 2/2005 Yamanaka et al. ..... 324/76.56
6,896,541 B2 5/2005 Benson
6,986,665 B2 1/2006 Schauz et al.
7,029,327 B2 4/2006 Devine
7,084,769 B2 8/2006 Bauer et al.
7,094,104 B1 * 8/2006 Burke et al. ..... 439/620.01
7,105,982 B1 9/2006 Hagood, IV et al.
7,173,343 B2 2/2007 Kugel
7,212,125 B2 5/2007 Shanks et al.
7,253,602 B2 * 8/2007 Shvach et al. ..... 324/127
7,254,511 B2 8/2007 Niedzwiecki et al.
7,262,626 B2 8/2007 Iwasaki
7,264,493 B2 9/2007 Cooper et al.
7,266,269 B2 9/2007 Koste et al.
7,268,517 B2 9/2007 Rahmel et al.
7,276,267 B2 10/2007 Schauz
7,276,703 B2 10/2007 Berkcan et al.
7,368,827 B2 5/2008 Kulkarni et al.
7,413,353 B2 8/2008 Beer et al.
7,440,253 B2 10/2008 Kauffman
7,472,587 B1 1/2009 Loehndorf et al.
7,479,886 B2 1/2009 Burr
7,482,945 B2 1/2009 Hall
7,507,117 B2 3/2009 Amidon
7,513,795 B1 4/2009 Shaw
7,544,086 B1 6/2009 Wells
7,642,611 B2 1/2010 Tsuji et al.
7,733,236 B2 6/2010 Montena et al.
7,749,022 B2 7/2010 Amidon et al.
7,775,115 B2 8/2010 Theuss et al.
7,850,482 B2 12/2010 Montena et al.
7,909,637 B2 3/2011 Montena
7,930,118 B2 * 4/2011 Vinden et al. ..... 702/64
8,092,234 B2 * 1/2012 Friedhof et al. ..... 439/76.1
8,149,127 B2 4/2012 Montena
2002/0090958 A1 7/2002 Ovard et al.
2003/0096629 A1 5/2003 Elliott et al.
2003/0148660 A1 8/2003 Devine
2004/0232919 A1 11/2004 Lacey
2006/0019540 A1 1/2006 Werthman et al.
2007/0173367 A1 7/2007 Duncan
2008/0258876 A1 10/2008 Overhultz et al.
2009/0022067 A1 1/2009 Gotwals
2009/0096466 A1 4/2009 Delforce et al.
2009/0115427 A1 5/2009 Radtke et al.
2009/0284354 A1 11/2009 Pinkham
2010/0081324 A1 4/2010 Montena
2010/0124838 A1 5/2010 Montena et al.
2010/0124839 A1 5/2010 Montena
2011/0074388 A1 3/2011 Bowman
2011/0080057 A1 4/2011 Bowman et al.
2011/0130034 A1 6/2011 Montena et al.

OTHER PUBLICATIONS

U.S. Appl. No. 12/965,961, filed Dec. 13, 2010; Confirmation No. 7882.
U.S. Appl. No. 12/966,113, filed Dec. 13, 2010; Confirmation No. 8139.
International Search Report and Written Opinion. PCT/US2010/052861. Date of Mailing: Jun. 24, 2011. 9 pages. Applicant's file ref.: ID-1295A-PCT.
U.S. Appl. No. 12/271,999, filed Nov. 17, 2008. Customer No. 5417.
Office Action (Mail date Jun. 28, 2012) for U.S. Appl. No. 12/965,961 filed Dec. 13, 2010.
Notice of Allowance (Mail date Jul. 11, 2012) for U.S. Appl. No. 12/960,592 filed Dec. 6, 2010.
Office Action (Mail date Jul. 2, 2012) for U.S. Appl. No. 12/966,113 filed Dec. 13, 2010.

* cited by examiner

INTERNAL COAXIAL CABLE CONNECTOR INTEGRATED CIRCUIT AND METHOD OF USE THEREOF

CROSS-REFERENCE TO RELATED APPLICATIONS

This application is a continuation-in-part of and claims priority from U.S. application Ser. No. 12/271,999 filed Nov. 17, 2008, now U.S. Pat. No. 7,850,482 issued on Dec. 14, 2010, and entitled COAXIAL CONNECTOR WITH INTEGRATED MATING FORCE SENSOR AND METHOD OF USE THEREOF.

BACKGROUND

1. Technical Field

The present invention relates generally to coaxial cable connectors. More particularly, the present invention relates to a coaxial cable connector and related methodology for processing conditions related to the coaxial cable connector connected to an RF port.

2. Related Art

Cable communications have become an increasingly prevalent form of electromagnetic information exchange and coaxial cables are common conduits for transmission of electromagnetic communications. Many communications devices are designed to be connectable to coaxial cables. Accordingly, there are several coaxial cable connectors commonly provided to facilitate connection of coaxial cables to each other and or to various communications devices.

It is important for a coaxial cable connector to facilitate an accurate, durable, and reliable connection so that cable communications may be exchanged properly. Thus, it is often important to ascertain whether a cable connector is properly connected. However, typical means and methods of ascertaining proper connection status are cumbersome and often involve costly procedures involving detection devices remote to the connector or physical, invasive inspection on-site. Hence, there exists a need for a coaxial cable connector that is configured to maintain proper connection performance, by the connector itself sensing the status of various physical parameters related to the connection of the connector, and by communicating the sensed physical parameter status through an output component of the connector. The instant invention addresses the abovementioned deficiencies and provides numerous other advantages.

SUMMARY

The present invention provides an apparatus for use with coaxial cable connections that offers improved reliability and a means of monitoring a quality of signals present on a coaxial cable.

A first aspect of the present invention provides a structure comprising: a sensing circuit mechanically connected to a disk structure located within a coaxial cable connector, wherein the sensing circuit is configured to sense a parameter of the coaxial cable connector; and an integrated circuit mechanically connected to the disk structure and electrically connected to the sensing circuit, wherein the integrated circuit is positioned within the connector, wherein the integrated circuit is configured to receive a parameter signal from the sensing circuit, wherein the parameter signal indicates the parameter of the coaxial cable connector, and wherein the integrated circuit is configured to convert the parameter signal into a data acquisition signal readable by the integrated circuit.

A second aspect of the present invention provides a structure comprising: a disk structure located within a coaxial cable connector; and an integrated circuit mechanically connected the disk structure, wherein the integrated circuit is positioned within the connector, wherein the integrated circuit is configured to receive a parameter signal from a sensing circuit, wherein the parameter signal indicates a parameter of the coaxial cable connector, and wherein the integrated circuit is configured to convert the parameter signal into a data acquisition signal readable by the integrated circuit.

A third aspect of the present invention provides a conversion method comprising: providing a sensing circuit and an integrated circuit mechanically connected to a disk structure located within a coaxial cable connector, wherein the integrated circuit is electrically connected to the sensing circuit; sensing, by the sensing circuit, a parameter of the coaxial cable connector; receiving, by the integrated circuit, a parameter signal from the sensing circuit, wherein the parameter signal indicates the parameter of the coaxial cable connector; and converting, by the integrated circuit, the parameter signal into a data acquisition signal readable by the integrated circuit.

The foregoing and other features of the invention will be apparent from the following more particular description of various embodiments of the invention.

DESCRIPTION OF THE DRAWINGS

Some of the embodiments of this invention will be described in detail, with reference to the following figures, wherein like designations denote like members, wherein.

DETAILED DESCRIPTION

Figure 1:
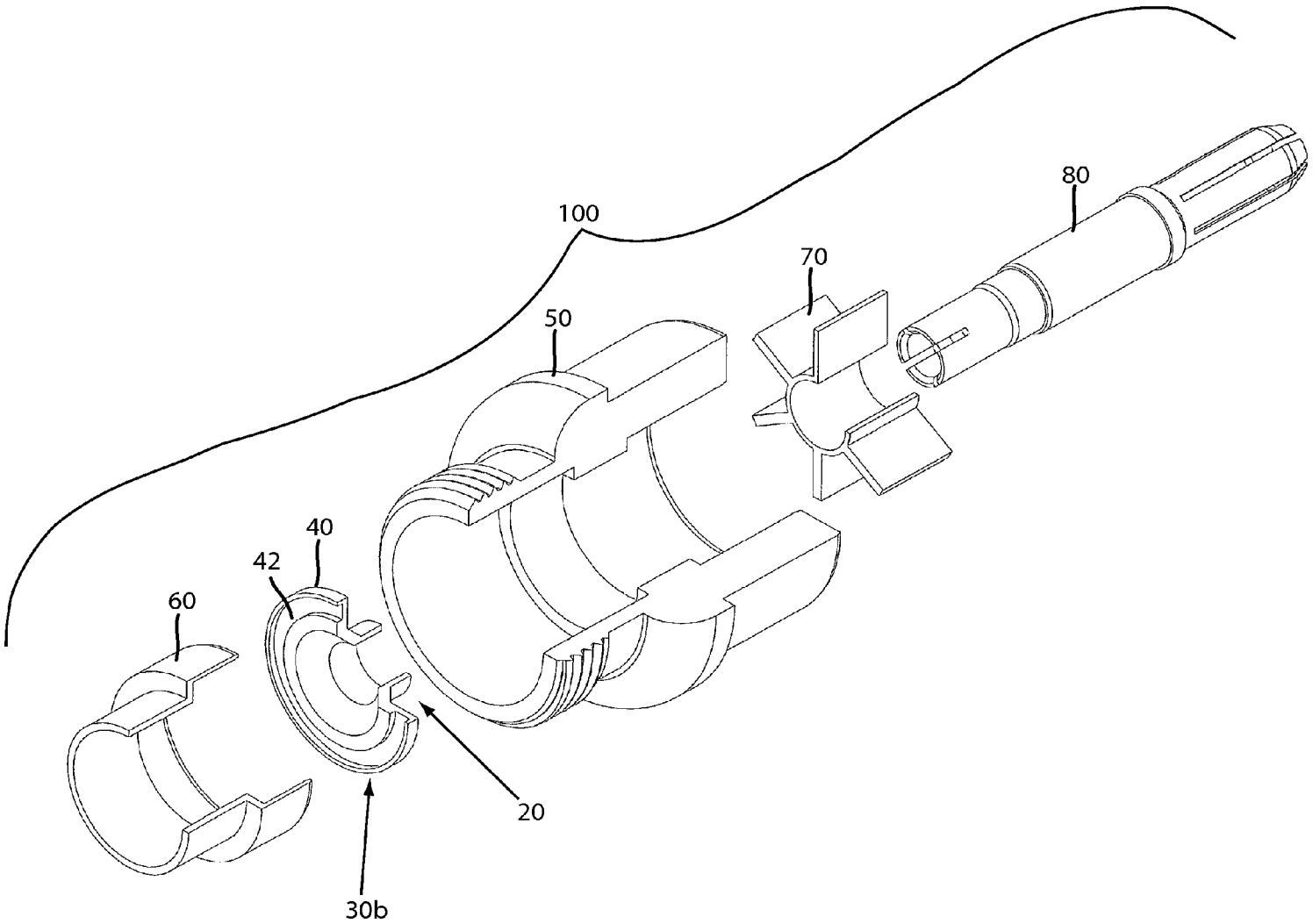
FIG. 1 depicts an exploded cut-away perspective view of an embodiment of a coaxial cable connector with a parameter sensing circuit, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

It is often desirable to ascertain conditions relative to a coaxial cable connector connection or relative to a signal flowing through a coaxial connector. A condition of a connector connection at a given time, or over a given time period, may comprise a physical parameter status relative to a connected coaxial cable connector. A physical parameter status is an ascertainable physical state relative to the connection of the coaxial cable connector, wherein the physical parameter status may be used to help identify whether a connector connection performs accurately. A condition of a signal flowing through a connector at a given time, or over a given time period, may comprise an electrical parameter of a signal flowing through a coaxial cable connector. An electrical parameter may comprise, among other things, an electrical signal (RF) power level, wherein the electrical signal power level may be used for discovering, troubleshooting and eliminating interference issues in a transmission line (e.g., a transmission line used in a cellular telephone system). Embodiments of a connector 100 of the present invention may be considered "smart", in that the connector 100 itself ascertains physical parameter status pertaining to the connection of the connector 100 to an RF port. Additionally, embodiments of a connector 100 of the present invention may be considered "smart", in that the connector 100 itself: detects; measures/processes a parameter of; and harvests power from an electrical signal (e.g., an RF power level) flowing through a coaxial connector.

Figure 2:
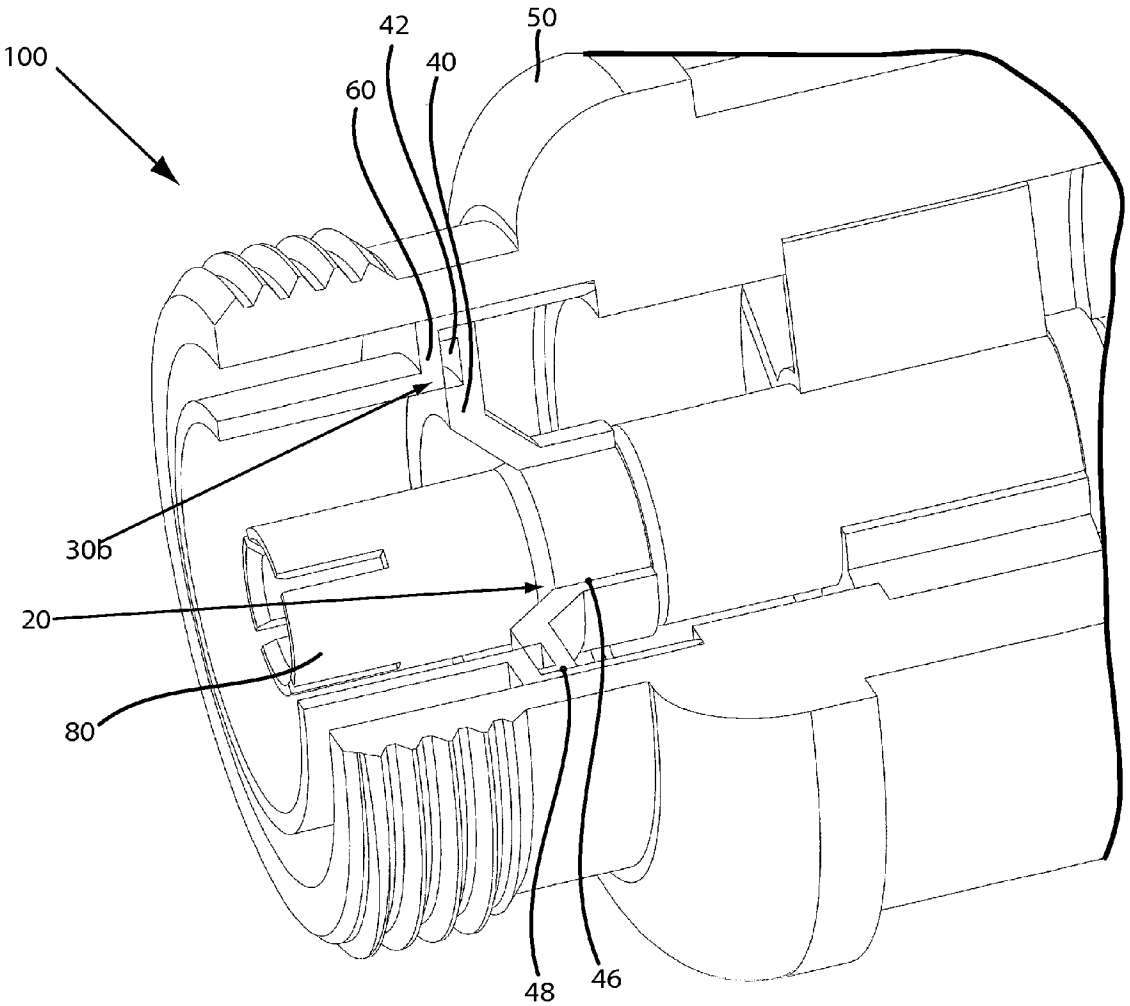
FIG. 2 depicts a close-up cut-away partial perspective view of an embodiment of a coaxial cable connector with a parameter sensing circuit, in accordance with the present invention.
Figure 3:
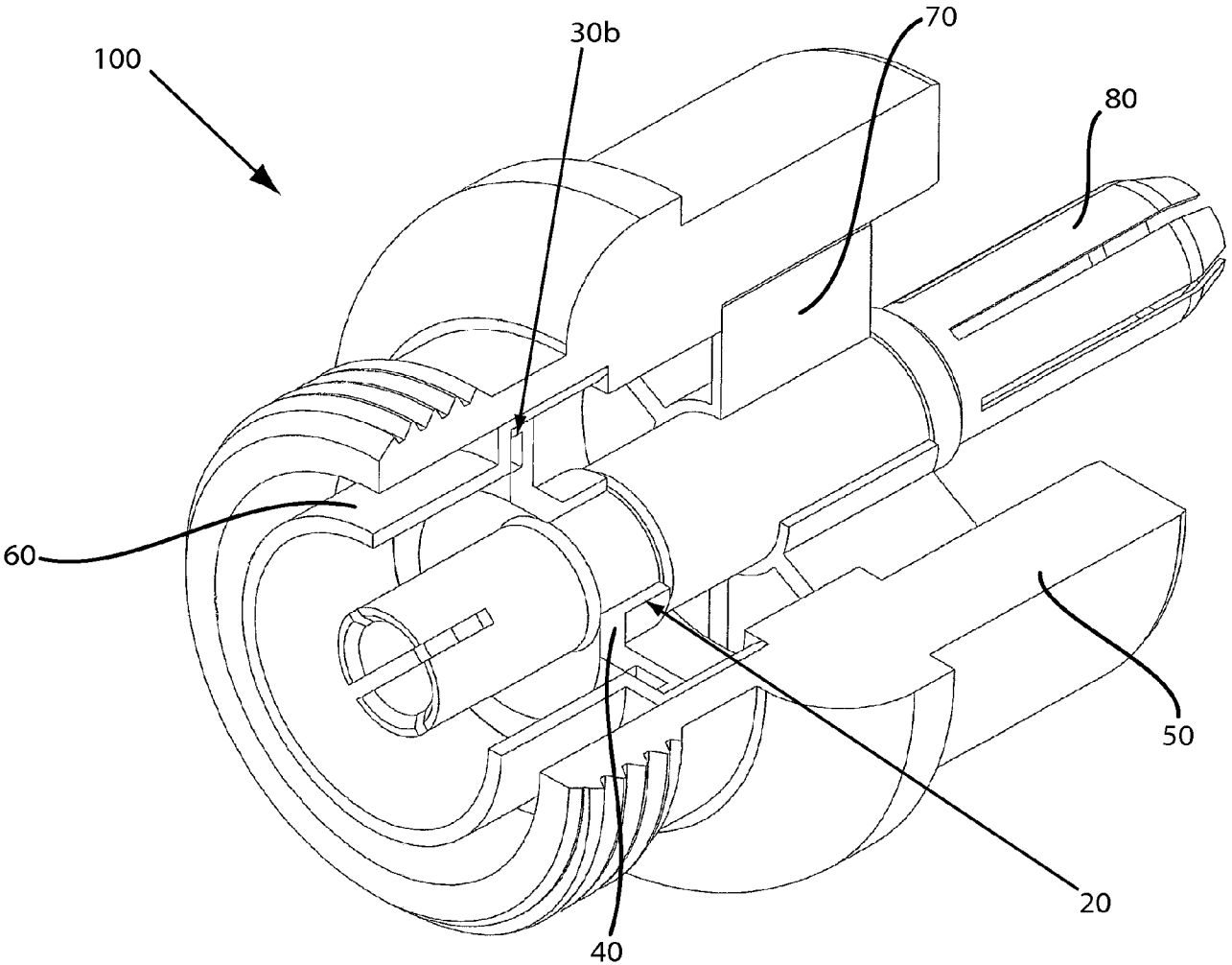
FIG. 3 depicts a cut-away perspective view of an embodiment of an assembled coaxial cable connector with an integrated parameter sensing circuit, in accordance with the present invention.

Referring to the drawings, FIGS. 1-3 depict cut-away perspective views of an embodiment of a coaxial cable connector 100 with an internal power harvesting (and parameter sensing) circuit 30*b*, in accordance with the present invention. The connector 100 includes a connector body 50. The connector body 50 comprises a physical structure that houses at least a portion of any internal components of a coaxial cable connector 100. Accordingly the connector body 50 can accommodate internal positioning of various components, such as a disk structure 40 (e.g., a spacer), an interface sleeve 60, a spacer 70, and/or a center conductor contact 80 that may be assembled within the connector 100. In addition, the connector body 50 may be conductive. The structure of the various component elements included in a connector 100 and the overall structure of the connector 100 may operably vary. However, a governing principle behind the elemental design of all features of a coaxial connector 100 is that the connector 100 should be compatible with common coaxial cable interfaces pertaining to typical coaxial cable communications devices. Accordingly, the structure related to the embodiments of coaxial cable connectors 100 depicted in the various FIGS. 1-12 is intended to be exemplary. Those in the art should appreciate that a connector 100 may include any operable structural design allowing the connector 100 to harvest power from a signal flowing through the connector 100, sense a condition of a connection of the connector 100 with an interface to an RF port of a common coaxial cable communications device, and report a corresponding connection performance status to a location outside of the connector 100. Additionally, connector 100 may include any operable structural design allowing the connector 100 to harvest power from, sense, detect, measure, and report a parameter of an electrical signal flowing through connector 100.

A coaxial cable connector 100 has internal circuitry that may harvest power, sense/process connection conditions, store data, and/or determine monitorable variables of physical parameter status such as presence of moisture (humidity detection, as by mechanical, electrical, or chemical means), connection tightness (applied mating force existent between mated components), temperature, pressure, amperage, voltage, signal level, signal frequency, impedance, return path activity, connection location (as to where along a particular signal path a connector 100 is connected), service type, installation date, previous service call date, serial number, etc. A connector 100 includes a parameter sensing/processing (and power harvesting) circuit 30*b*. The parameter sensing/processing (and power harvesting) circuit 30*b* includes an embedded coupler device 515, sensors 560, and an integrated circuit 504*b* (e.g., a semiconductor device such as, among other things, a semiconductor chip) that may include an impedance matching circuit 511, an RF power sensing circuit 502, a RF power harvesting/power management circuit 529, and a sensor front end circuit 569, an analog to digital convertor (ADC) 568, a digital control circuit 567, a clock and data recovery CDR circuit 572, a transmit circuit (Tx) 570*a*, and a receive circuit (Rx) 570*b* as illustrated and described with respect to FIGS. 4 and 5A. The power harvesting (and parameter sensing) circuit 30*a* may be integrated onto or within typical coaxial cable connector components. The parameter sensing/processing circuit 30*b* may be located on/within existing connector structures. For example, a connector 100 may include a component such as a disk structure 40 having a face 42. The parameter sensing/processing circuit 30*b* may be positioned on and/or within the face 42 of the disk structure 40 of the connector 100. The parameter sensing/processing circuit 30*b* is configured to: sense an R/F signal flowing through the connector 100; harvest power from the R/F signal flowing through the connector 100; and process and report conditions (e.g., temperature, connector tightness, relative humidity, etc) associated with the connector 100 when connected to an RF port. The power connector 100 when the connector 100 is connected with an interface of a common coaxial cable communications device, such as interface port 15 of receiving box. Moreover, various portions of the circuitry of the sensing/processing circuit 30*b* may be fixed onto multiple component elements of a connector 100.

Power for sensing/processing circuit 30*b* (e.g., the integrated circuit 504*b*) and/or other powered components of a connector 100 may be provided through retrieving energy from an R/F signal flowing through the center conductor 80. For instance, traces may be printed on and/or within the disk structure 40 and positioned so that the traces make electrical contact with (i.e., coupled to) the center conductor contact 80 at a location 46 (see FIG. 2). Contact with the center conductor contact 80 at location 46 facilitates the ability for the sensing/processing circuit 30*b* to draw power from the cable signal(s) passing through the center conductor contact 80. Traces may also be formed and positioned so as to make contact with grounding components. For example, a ground path may extend through a location 48 between the disk structure 40 and the interface sleeve 60, or any other operably conductive component of the connector 100. Those in the art should appreciate that a sensing/processing circuit 30*b* should be powered in a way that does not significantly disrupt or interfere with electromagnetic communications that may be exchanged through the connector 100.

Figure 4:
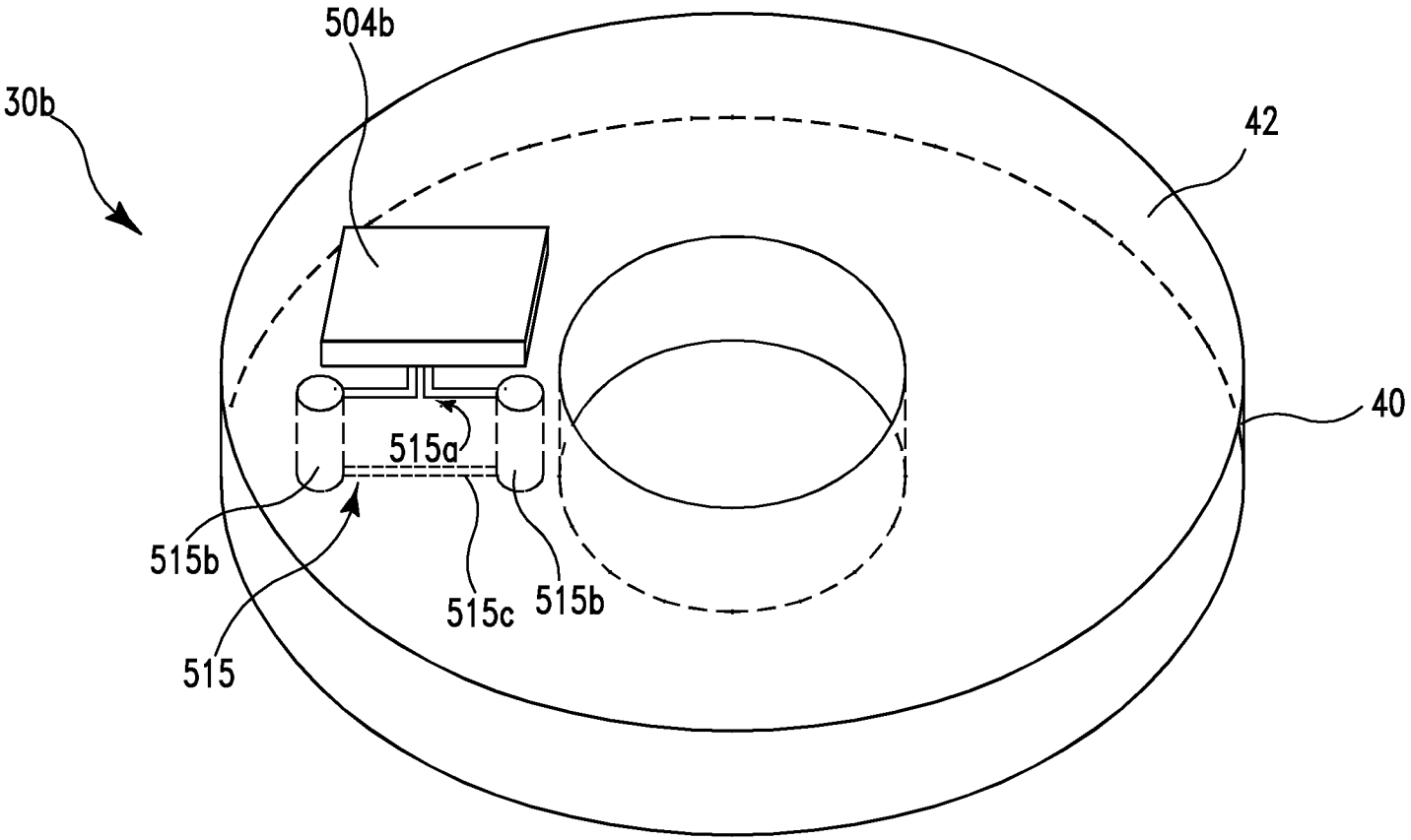
FIG. 4 depicts a perspective view of an embodiment of the disk structure 40 of FIGS. 1-3, in accordance with the present invention.

With continued reference to the drawings, FIG. 4 depicts a perspective view of an embodiment of the disk structure 40 of FIGS. 1-3. The disk structure 40 includes the sensing/processing circuit 30*b*. The sensing/processing circuit 30*b* includes an embedded coupler device 515 (including wire traces 515*a*, metallic cylindrical structures 515*b* extending from a bottom surface through a top surface 42 of disk structure 40, and a wire trace 515*c* connecting metallic cylindrical structures 515*b* thereby forming a loop coupler structure), sensors 560, and an integrated circuit 504*b* (e.g., a semiconductor device such as, among other things, a semiconductor chip) that may include an impedance matching circuit 511, an RF power sensing circuit 502, a RF power harvesting/power management circuit 529, and a sensor front end circuit 569, an analog to digital convertor (ADC) 568, a digital control circuit 567, a clock and data recovery (CDR) circuit 572, a transmit circuit (Tx) 570*a*, and a receive circuit (Rx) 570*b* as schematically illustrated and described with respect to FIG. 5A). Although embedded coupler device 515 is illustrated as cylindrical structures extending from a top surface 42 through a bottom surface of disk structure 40, note that embedded coupler device 515 may comprise any geometrical shape (e.g., circular, spherical, cubicle, etc). Embedded coupler device 515 may include a directional coupler and/or a loop coupler that harvests power from a radio frequency (RF) signal being transmitted down a transmission line (and through connector 100 of FIGS. 1-3) and extracts a sample of the RF signal for detecting conditions of the connector 100. The harvested power may be used to power electronic transducers/sensors (e.g., sensors 560 in FIG. 5A) for generating data regarding a performance, moisture content, tightness, efficiency, and alarm conditions within the connector 100. Additionally, the harvested power may be used to power the integrated circuit 504*b*. Disk structure 40 provides a surface 42 for implementing a directional coupler. FIG. 4 illustrates an embedded directional coupler (i.e., coupler device 515) mounted on/within the disk structure 40 located internal to connector 100. Coupler device 515 harvests energy from an RF signal on the transmission line (e.g., a coaxial cable for an R/F tower). Coupler device 515 additionally provides a real time measurement of RF signal parameters on the transmission line (e.g., a coaxial cable). Disk structure 40 incorporates electronic components (e.g., integrated circuit 504*b* such as a signal processor) to harvest the power, condition the sensed parameter signals (i.e., sensed by coupler device 515), and transmit a status of the connector 100 condition over a telemetry system. Signals sensed by the coupler device 515 may include a magnitude of a voltage for forward and reverse propagating RF waveforms present on a coaxial cable center conductor (e.g., center conductor 80 of FIGS. 1-3) relative to ground. A geometry and placement of the coupler device 515 on the disk structure 515 determines a calibrated measurement of RF signal parameters such as, among other things, power and voltage standing wave ratio. Coupler device 515 allows for a measurement of forward and reverse propagating RF signals along a transmission line thereby allowing a measurement of a voltage standing wave ratio and impedance mismatch in a cabling system of the transmission line. The disk structure 40 (including the internal sensing/processing circuit 30*b* may be implemented within systems including coaxial cables and RF connectors used in cellular telephone towers. The disk structure 40 made include syndiotactic polystyrene. An electroplated metallurgy may be used (i.e., on/within the disk structure 40) to form the coupler device 515 and electronic interconnects (e.g., wire traces 515*a*) to the sensing/processing circuit 30*b*. The coupler device 515 may be used in any application internal to a coaxial line to harvest power from RF energy propagating along the center coaxial line. The coupler device 515 may be used to measure directly and in real time, a calibrated sample of forward and reverse voltages of the RF energy. The calibrated sample of the forward and reverse voltages may provide key information regarding the quality of the coaxial cable and connector system. Additionally, a propagated RF signal and key parameters (such as power, voltage standing wave ratio, intersectional cable RF power loss, refection coefficient, insertion loss, etc) may be determined. A coaxial transmission line supports a transmission electron microscopy (TEM) mode electromagnetic wave. TEM mode describes a property of an orthogonal magnetic and electric field for an RF signal. TEM mode allows for an accurate description of the electromagnetic field's frequency behavior. An insertion of an electrically small low coupling magnetic antenna (e.g., coupler device 515) is used to harvest power from RF signals and measure an integrity of passing RF signals (i.e., using the electromagnetic fields' fundamental RF behavior). Coupler device 515 may be designed at a very low coupling efficiency in order to avoid insertion loss. Harvested power may be used to power an on board data acquisition structure (e.g., integrated circuit 504*b*). Sensed RF signal power may be fed to an on board data acquisition structure (e.g., integrated circuit 504*b*). Data gathered by the integrated circuit 504*b* is reported back to a data gathering device (e.g., transmitter 510*a*, receiver 510*b*, or combiner 545 in FIGS. 5A and 5B) through the transmission path (i.e., a coaxial cable) or wirelessly.

Figure 5A:
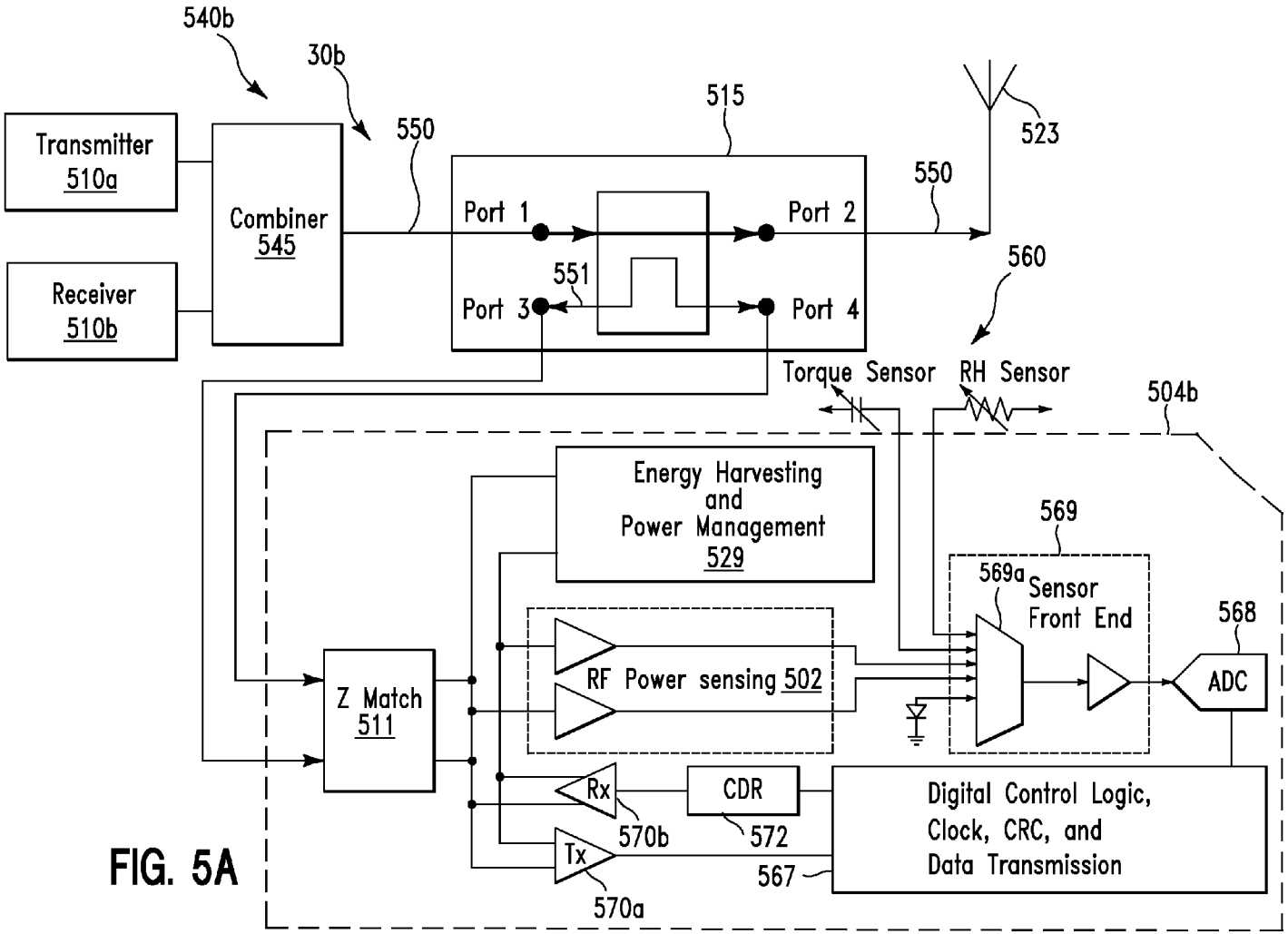
FIG. 5A depicts a schematic block diagram view of an embodiment of a system including the power harvesting and parameter sensing circuit of FIGS. 1-4, in accordance with the present invention.

FIG. 5A shows schematic block diagram view of an embodiment of a system 540*b* including sensing/processing circuit 30*b* connected between (e.g., via a coaxial cable(s)) an antenna 523 (e.g., on a cellular telephone tower) and a transmitter 510*a* and receiver 510*b* (connected through a combiner 545). Although system 540*b* of FIG. 5 only illustrates one sensing/processing circuit 30*b* (within a coaxial cable connector), note that system 540*b* may include multiple sensing/processing circuits 30*b* (within multiple coaxial cable connectors) located at any position along a main transmission line 550 (as illustrated and described with respect to FIG. 5B). Embodiments of a sensing/processing circuit 30*b* may be variably configured to include various electrical components and related circuitry so that a connector 100 can harvest power, measure, or determine connection performance by sensing a condition relative to the connection of the connector 100, wherein knowledge of the sensed condition may be provided as physical parameter status information and used to help identify whether the connection performs accurately. Accordingly, the circuit configuration as schematically depicted in FIG. 5A is provided to exemplify one embodiment of sensing/processing circuit 30*b* that may operate with a connector 100. Those in the art should recognize that other sensing/processing circuit 30*b* configurations may be provided to accomplish the power harvesting, sensing of physical parameters, and processing corresponding to a connector 100 connection. For instance, each block or portion of the sensing/processing circuit 30*b* can be individually implemented as an analog or digital circuit.

As schematically depicted, a sensing/processing circuit 30*b* may include an embedded coupler device 515 (e.g., a directional (loop) coupler as illustrated), sensors 560, and an integrated circuit 504*b* (e.g., a semiconductor device such as, among other things, a semiconductor chip) that may include an impedance matching circuit 511, an RF power sensing circuit 502, a RF power harvesting/power management circuit 529, and a sensor front end circuit 569, an analog to digital convertor (ADC) 568, a digital control circuit 567, a clock and data recovery CDR circuit 572, a transmit circuit (Tx) 570*a*, and a receive circuit (Rx) 570*b*. A directional coupler couples energy from main transmission line 550 to a coupled line 551. The transmitter 510*a*, receiver 510*b*, and combiner 545 are connected to the antenna 523 through coupler device 515 (i.e., the transmitter 510*a*, receiver 510*b*, and combiner 545 are connected to port 1 of the coupler device 515 and the antenna is connected to port 2 of the coupler device 515) via a coaxial cable with connectors. Ports 3 and 4 (of the coupler device 515) are connected to an impedance matching circuit 511 in order to create matched terminated line impedance (i.e., optimizes a received RF signal). Impedance matching circuit 511 is connected to RF power sensing circuit 502 and RF power harvesting/power management circuit 529 and sensor front end circuit 569 (e.g., including a multiplexer 569*a*). The RF power harvesting/power management circuit 529 receives and conditions (e.g., regulates) the harvested power from the coupler device 515. A conditioned power signal (e.g., a regulated voltage generated by the RF power harvesting/power management circuit 529) is used to power any on board electronics in the connector. The RF power sensing circuit 502 receives (from the coupler device 515) a calibrated sample of forward and reverse voltages (i.e., from the coaxial cable). A propagated RF signal and key parameters (such as power, voltage standing wave ratio, intersectional cable RF power loss, refection coefficient, insertion loss, etc) may be determined (from the forward and reverse voltages) by the RF power sensing circuit 502. The sensor front end circuit 569 is connected between the RF power sensing circuit 502 and the ADC 568. Additionally, sensors 560 are connected to sensor front end circuit 569. Although sensors 560 in FIG. 5 are illustrated as a torque sensor and a relative humidity sensor, note that are sensor may be connected to sensor front end circuit 569 for signal processing. For example, sensors 560 may include, among other things, a capacitive sensor structure, a temperature sensor, an optical/electric sensor, a resistance based sensor, a strain connection tightness sensor, etc. The sensor front end circuit 569 provides protocols and drive circuitry to transmit sensor data (i.e., from coupler device 515 and/or sensors 560 after processing by ADC 568, digital control circuit 567, and CDR 572) back to the coaxial line for transmission to a data retrieval system (e.g., receiver 510*b*). The receiver 510*b* may include signal reader circuitry for reading and analyzing a propagated RF signal flowing through main transmission line 550. SCIC has been optimized to sense the status of a coaxial cable connector system, extract power from the coaxial cable system, and report the status of the cable system by providing data transfer between the center conductor of the coaxial line in a transmission and reception mode.

System 540*a* of FIG. 5A incorporates the integrated circuit 504*b* with the sensors 560 for detecting connector failure mechanisms. A telemetry technology reports the connector integrity with a unique identification for each connector to a central dispatch location (e.g., receiver 510*b*). A degrading quality in a connector may be detected and corrected before a catastrophic failure occurs. Integrated circuit 504*b* is integrated with disk 40 (of FIGS. 1-4) comprising interconnect metallurgy to sensors 560 and coupler device 515. Integrated circuit 504*b* comprises an architecture to sense connector tightness, connector moisture, harvest RF power for powering the integrated circuit 504*b* (and any additional components on the disk), monitor a quality of an RF signal on the coaxial cable, measure inside cable temperature, enable unique SC identification, provide a telemetry system for communicating the system 540*b* status, etc. Integrated circuit 504*b* is packaged to tolerate EMI events common in coaxial cable environments such as, among other things, lightning or ground potential shifts, normal operating RF power on the coaxial system (e.g., 20 watts of RF power), etc. An example embodiment of the integrated circuit 504*b* may enable and/or include the following eight subsystems:

1. Connector Tightness Sensing

Integrated circuit 504*b* uses electrostatic proximity detection to measure coaxial cable connector mating tightness. When tightening a coaxial cable connector, a grounded metallic ring in a female body of the (connector) moves toward a sensing ring on the disk 40 surface thereby changing an effective capacitance. As the connection becomes tighter, the effective capacitance increases. A two electrode capacitance structure (e.g., a Wheatstone capacitance bridge) may be used in the connector. A 20 KHz 3 VPP sinusoidal signal may be used to stimulate the bridge. A differential amplifier senses the error voltage developed on interior nodes of the bridge and converts the error voltage to a dc voltage related to connector tightness.

2. Relative Humidity Sensing

Integrated circuit 504*b* enables relative humidity (RH) sensing based on a four resistor Wheatstone bridge. The RH sensing resistor may be fabricated adjacent to integrated circuit 504*b* using an inter-digitated metallic finger array coated with a (nafion hydrophilic) film. Under the influence of water vapor at a surface of the film, the film conductivity varies with relative humidity and induces a change in inter-electrode resistance with respect to relative humidity. An offset voltage is proportional to the resistance bridge imbalance and therefore the relative humidity is amplified by a differential amplifier.

3. Temperature Sensing

Integrated circuit 504*b* enables temperature sensing to allow for temperature compensation of transducing elements and to monitor a temperature environment of a coaxial cable connector body. Integrated circuit 504*b* enables a fixed bias current to develop a forward bias voltage across a p-n junction. The p-n junction voltage exhibits fractional temperature coefficient of approximately −2 mV/° C.

4. RF Power Sensing

As an electromagnetic wave propagates along a coaxial cable it experiences loss due to series and shunt resistance in the cable. Although coaxial cables are carefully designed to minimize propagation loss, a signal may experience additional loss if coaxial cable connectors are compromised by moisture ingress, loose connector mating, or mechanical damage. Integrated circuit 504*b* enables a measurement of instantaneous RF power at each coaxial cable connector to monitor the coaxial cable connector and coaxial cable viability and to identify specific fault locations. Coupler device 515 measures instantaneous RF power at each coaxial cable connector (i.e., propagating in a forward or reverse direction) and is connected to the integrated circuit 504*b* for signal processing and conversion to a corresponding digital value. Relative voltage magnitudes of forward or reverse traveling RF waves allow for RF measurement such as, among other things, standing wave ratios, impedance mismatch, etc.

5. Power Extraction

Power (i.e., for operation) for integrated circuit 504*b* is derived from power harvested from a transmission line. A RF signal transmitted by a master terminal (e.g., transmitter 510*a*) is coupled to the integrated circuit 504*b* from the transmission line via coupler device 515. The coupled RF signal is converted to a regulated DC voltage (e.g., 3.3 vdc on-chip power supply) and provides a time base for integrated circuit 504*b* clocking. The integrated circuit 504*b* extracts less than 3 mW of power from the transmission line.

6. Data Conversion

A signals generated by transducers (e.g., sensors 560) are conditioned into a dc voltage. Each sensor dc signal may be selected by a six channel multiplexer (e.g., multiplexer 569) and converted to an 8-bit equivalent digital value by a dual slope integrating analog to digital converter (e.g., ADC 568). The dual slope ADC may enable natural noise suppression by its integrating action and operates at low bias currents.

7. Telemetry

The remote slave status (i.e., for the semiconductor device 504*b*) may be transmitted to a master terminal over a coaxial cable via the coupler device 515. A data stream (for the remote slave status) may include an 8-bit parameter value for each of sensor signal, an 8 bit chip address, and an 8 bit cyclic redundancy code (CRC) for reliable communication.

8. Substrate and Packaging

The integrated circuit 504*b* may be mounted on a copper substrate to act as a faraday cage to shield the integrated circuit 504*b* from frequencies from 1 MHz to 3 GHz.

Figure 5B:
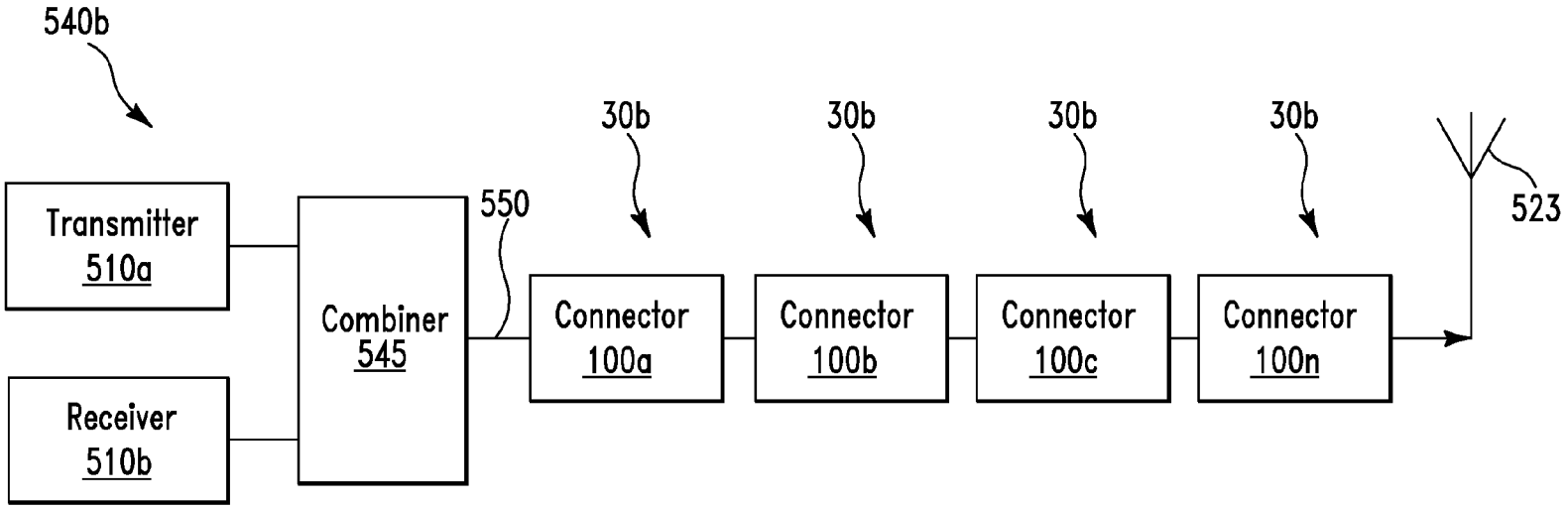
FIG. 5B depicts schematic block diagram view of an embodiment of system the system of FIG. 5A including multiple sensing/processing circuits located in multiple coaxial cable connectors, in accordance with the present invention.

FIG. 5B shows schematic block diagram view of an embodiment of system 540*b* of FIG. 5A including multiple sensing/processing circuits 30*b* located in multiple coaxial cable connectors 100*a* . . . 100*n* connected between (e.g., via a coaxial cable(s)) antenna 523 (e.g., on a cellular telephone tower) and transmitter 510*a* and receiver 510*b* (connected through a combiner 545). Each of coaxial cable connectors 100*a* . . . 100*n* (comprising an associated sensing/processing circuit 30*b*) in includes an RF energy sensing/extraction point. The RF energy may be transmitted from an existing RF communication signal or a dedicated RF energy signal dedicated to providing power for each sensing/processing circuit 30*b*.

Figure 6:
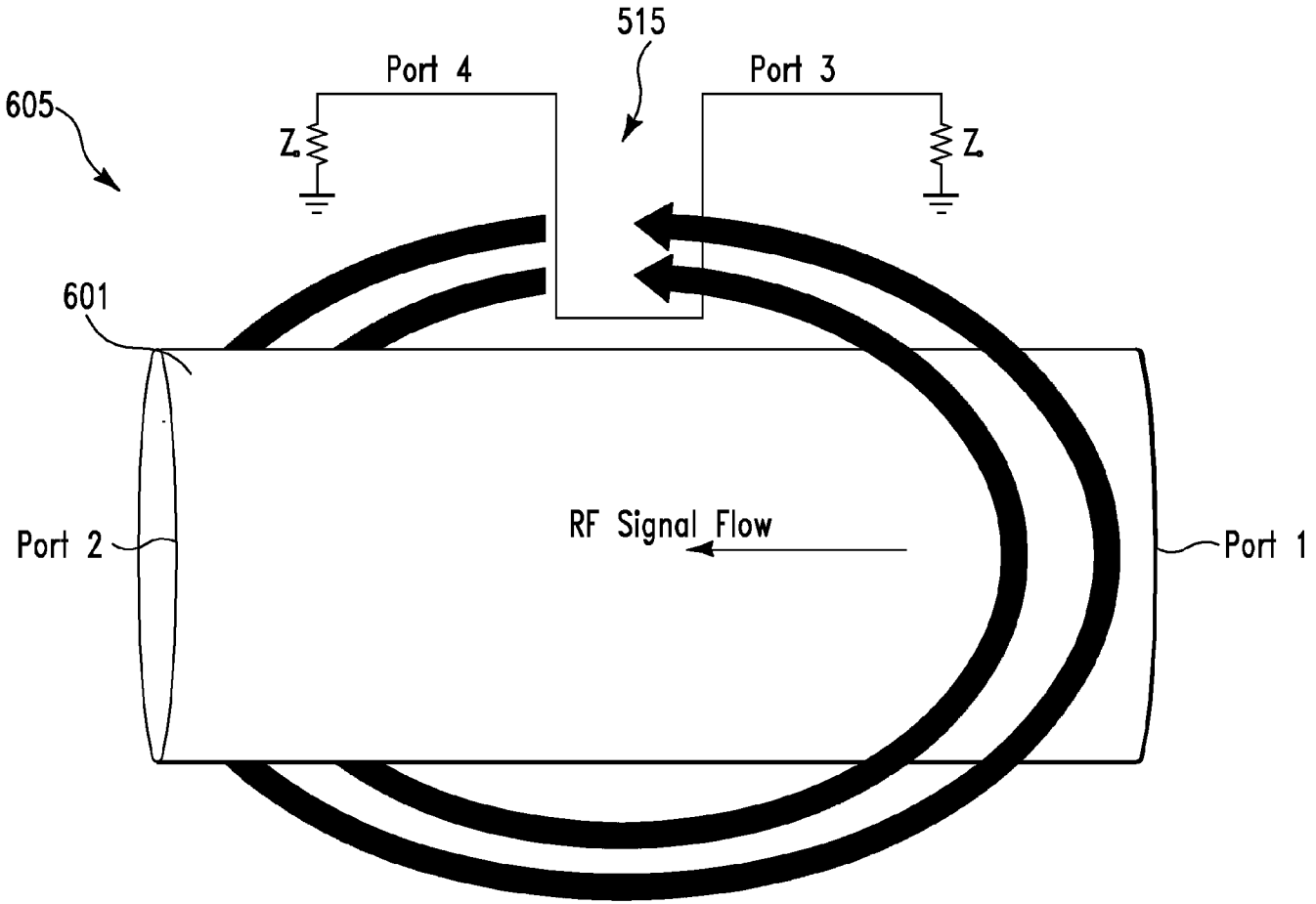
FIG. 6 depicts a perspective view of an embodiment of a loop coupler device, in accordance with the present invention.

FIG. 6 depicts a perspective view of an embodiment of the coupler device 515 (e.g., a loop coupler structure) of FIGS. 1-5B. FIG. 6 illustrates a magnetic field 605 established by an AC current through a center conductor 601 (of a coaxial cable) penetrating a suspended loop (e.g., coupler device 515). Coupler device 515 includes a gap between the center conductor 601 and a substrate to avoid a sparking effect between the center conductor 601 and outer shielding that often occurs under surge conditions. An RF signal passing through the center conductor 601 establishes an azimuthally orbiting magnetic field 605 surrounding the center conductor 601. A conductive loop structure (e.g., coupler device 515) that supports a surface that is penetrated by the orbiting magnetic field 605 will induce a current through its windings and induce a voltage (i.e., harvested power) across its terminals dependent upon a termination impedance. The conductive loop structure is constructed to surround an open surface tangent to the azimuthal magnetic field 605 and induce the aforementioned current. End leads of the conductive loop structure emulate a fully connected loop while maintaining electrical separation thereby allowing for a voltage (i.e., for power electronics within the connector 100) to be developed across terminals (ports 3 and 4).

Figure 7A:
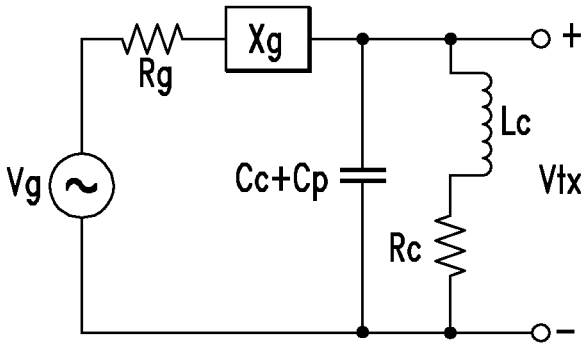
FIGS. 7A-7C depict schematic views of embodiments of the coupler device of FIGS. 1-6, in accordance with the present invention.
Figure 7B:
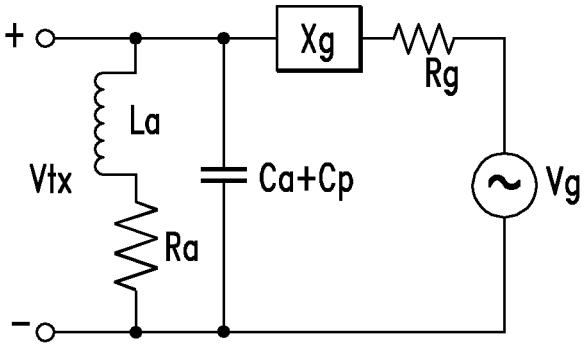
Figure 7C:
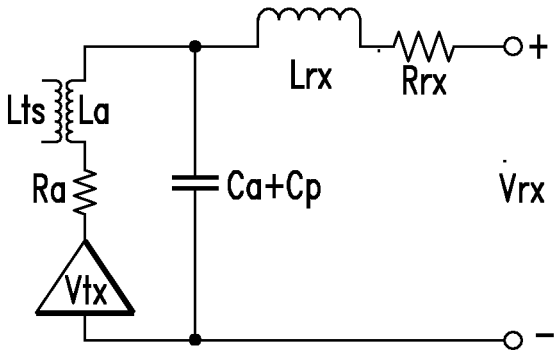

FIGS. 7A-7C depict schematic views of an embodiments of the coupler device 515 (e.g., a loop coupler structure) of FIGS. 1-6. As RF power is passed through a coupling structure (e.g., coupler device 515) and a coaxial line, the coupling structure will transmit a portion of the RF power as electric and magnetic components inside the coaxial structure thereby inducing a current down the center conductor and establishing a TEM wave inside the coaxial structure. The coaxial line will drive the TEM wave through the open space occupied by the coupling structure and will induce fields that will couple energy into the structures. FIGS. 7A-7C depict a TX of power from the coupling structure to a coaxial line and vice versa.

FIG. 7A demonstrates a TX lumped circuit model of a coaxial line. Model parameters including a subscript "g" indicate generator parameters. The generator parameters comprise inductive and resistive Thevenin values at an output of the coupling structure to the coaxial line. Model parameters with a subscript "c" describe inductance, capacitance, and resistance of the coaxial line at the point of the coupling structure's placement. Model parameter Cp comprises a parasitic capacitance with non-coaxial metallic structures and is on the order of pF. Vtx comprises a transmission voltage that induces an electric or magnetic field component that excites the coupling structure. The following equations 1 and 2 define power transfer equations for a generator perturbing the coaxial line. Equation 1 expresses a transmission voltage in terms a generator voltage divided down by transmitter impedances.

$$V_{TX} = \frac{V_G}{Z_G + Z_{Cc//(Lc+Rc)}} \qquad \text{Equation 1}$$

Equation 2 expresses a transmission power in terms of lumped circuit components.

$$P_{TX} = \frac{1}{2}|I_{TX}|^2 R_C = \frac{1}{2}\frac{|V|^2 R_C}{|Z_G + Z_{Cc//(Lc+Rc)}|^2} \qquad \text{Equation 2}$$

FIG. 7B demonstrates RF power transmitted in a TEM wave along a coaxial line's length. The TEM wave is received by the coupling structure and an induced power is brought through the coupling structure to internal electronics. A frequency dependant reception of the RF power is dictated by the particular impedances caused by the inductive coupling between the conductive structures, the capacitive coupling with the grounded metal shielding, and the mixed coupling with the other metallic traces within the coaxial environment.

FIG. 7C demonstrates an Irx current source comprising an induced dependant current that varies with the power and frequency of the transmitted signal along the coaxial line. The La, Ra, and Ca elements are intrinsic and coupling impedances of the loop coupler positioned near the coaxial line. Cp comprises a parasitic capacitance due to a surrounding grounded metal connector housing. The Lrx and Rrx elements comprise impedances used to tune the coupling structure for optimum transmission at select frequencies. Vrx comprises a received voltage to internal electronics. Lts is comprises a mutual inductance created from coupling between the coupling structure and a metallic structure used to tune the coupling structure's resistive impedance at a select power transfer frequency.

Figure 8B:
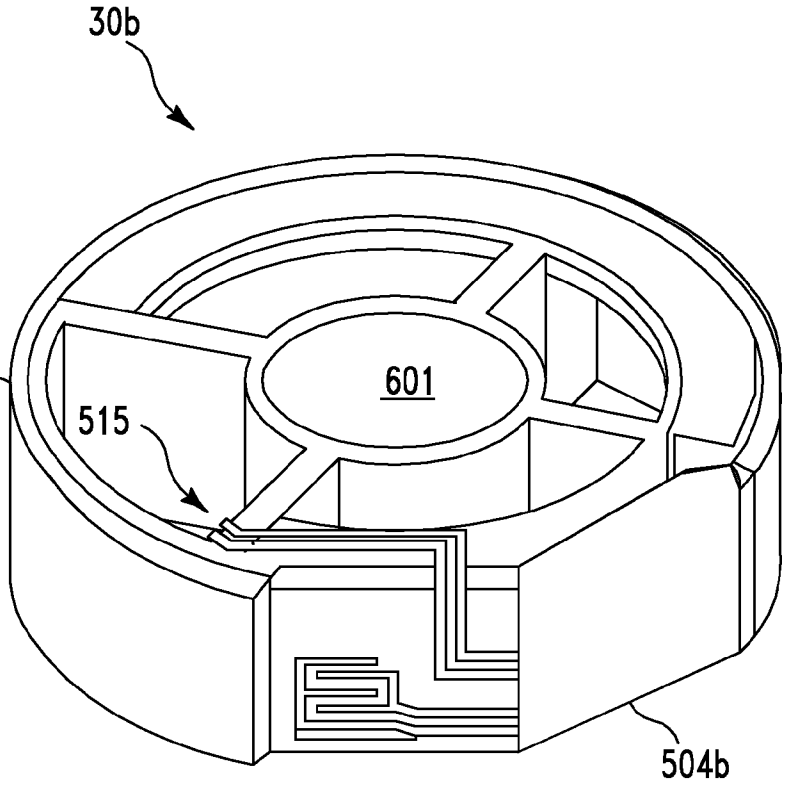
FIGS. 8A-8D depict perspective views of embodiments of the disk structure of FIGS. 1-5B, in accordance with the present invention.
Figure 8A:
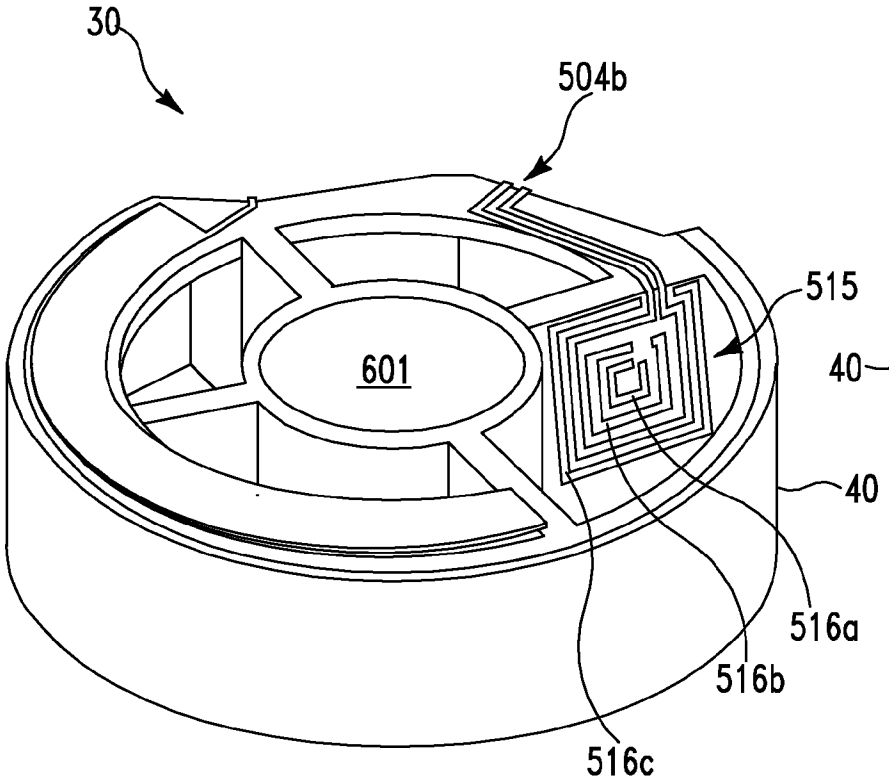

FIG. 8A depicts a first perspective view of an embodiment of the disk structure 40 comprising the internal sensing/processing circuit 30*b* of FIGS. 1-6. FIG. 8A illustrates coupler device 515 mounted to or integrated with disk structure 40. Coupler device 515 illustrated in FIG. 8B depicts a second perspective view of an embodiment of the disk structure 40 comprising the internal sensing/processing circuit 30*b* of FIGS. 1-6. FIG. 8B illustrates the integrated circuit 504*b* mounted to or integrated with a recesses within a side portion of the disk structure 40.

Figure 8C:
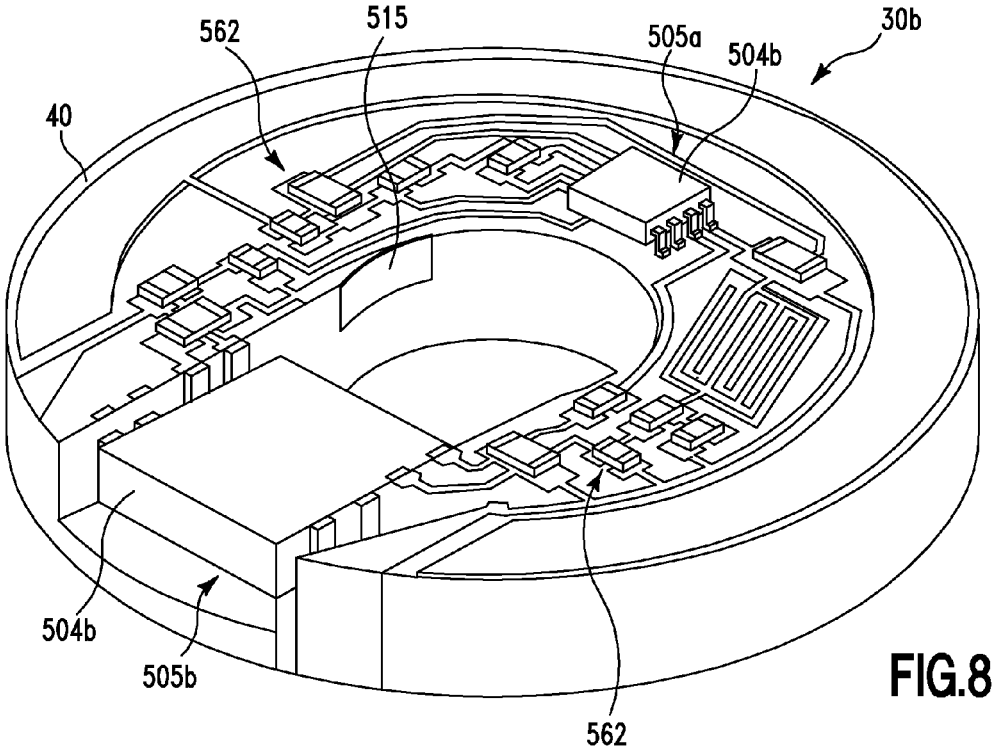

FIG. 8C depicts a perspective view of an embodiment of the disk structure 40 comprising a top mounted version of the internal sensing/processing circuit 30*b* of FIGS. 1-6. The sensing/processing circuit 30*b* of FIG. 8C includes two different versions (either version may be used) of the integrated circuit 504*b*: a top mounted version 505*a* and a recessed mounted version 505*b*. Alternatively, a combination of the top mounted version 505*a* and the recessed mounted version 505*b* of the integrated circuit 504*b* may be used in accordance with embodiments of the present invention. Additionally, the disk structure 40 may comprise additional electrical components 562 (e.g., transistors, resistors, capacitors, etc)

Figure 8D:
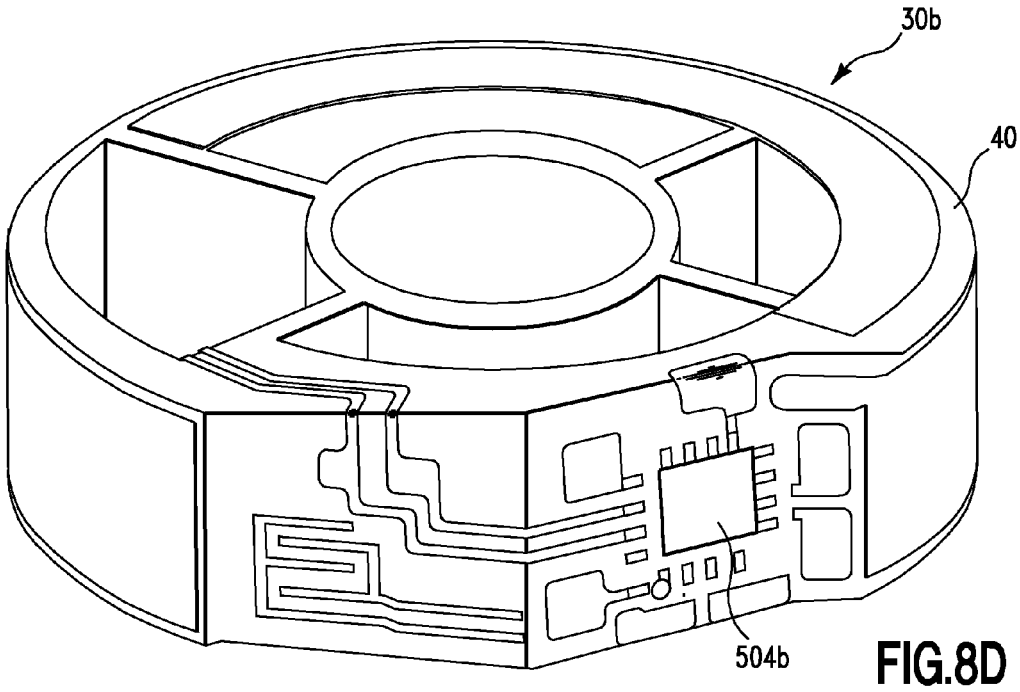

FIG. 8D depicts a perspective view of an embodiment of the disk structure 40 comprising the integrated circuit 504*b* mounted to or integrated with a side portion of the disk structure 40.

Figure 9:
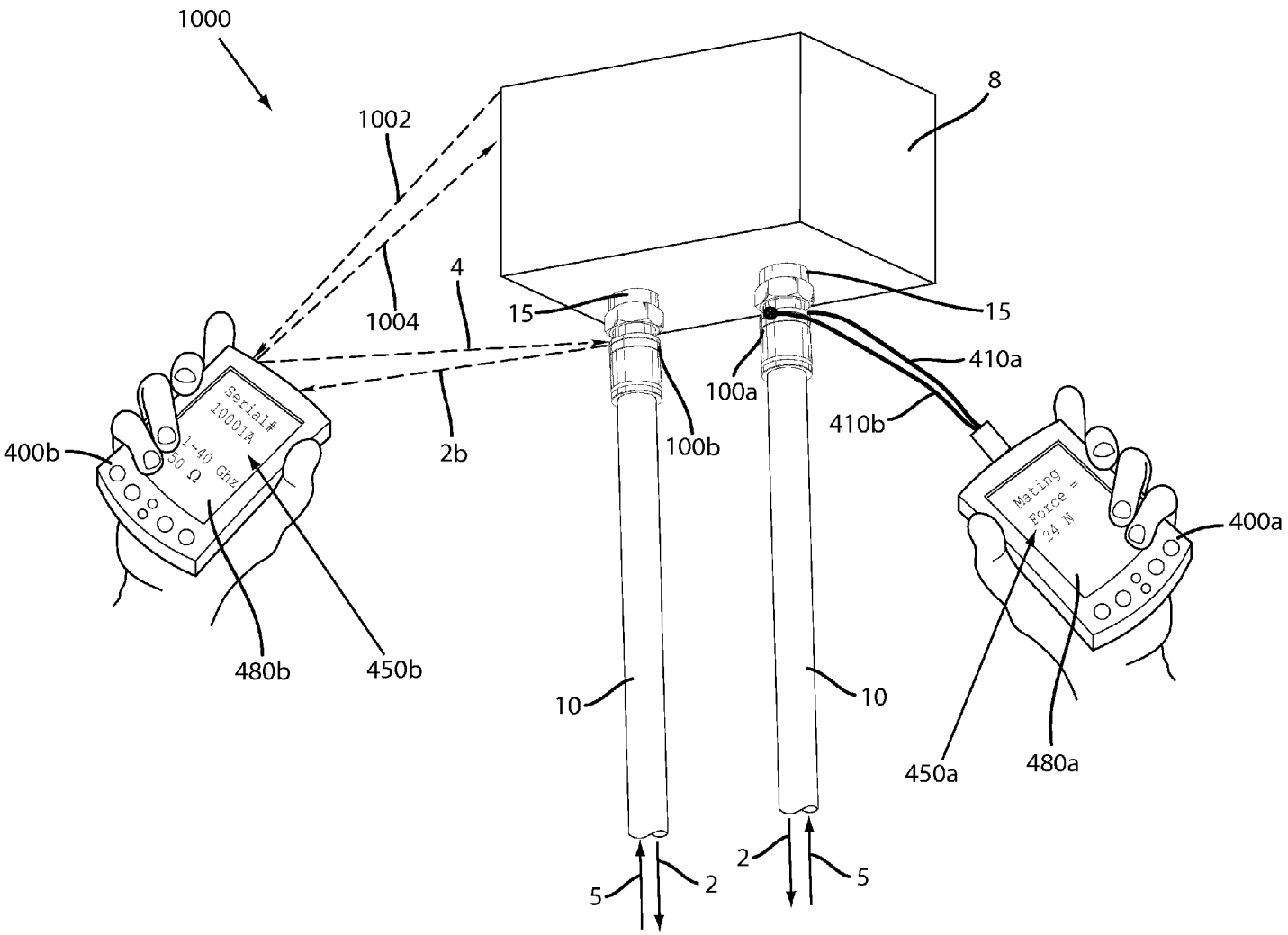
FIG. 9 depicts a perspective view of an embodiment of a physical parameter status/electrical parameter reader, in accordance with the present invention.

Referring further to FIGS. 1-8D and with additional reference to FIG. 9, embodiments of a coaxial cable connection system 1000 may include a physical parameter status/electrical parameter reader 400 (e.g., transmitter 510*a*, receiver 510*b*, and/or any other signal reading device along cable 10) located externally to the connector 100. The reader 400 is configured to receive, via a signal processing circuitry (e.g., any the integrated circuit 504*b* of FIG. 5A) or embedded coupler device 515 (of FIG. 5A), information from the power harvesting (and parameter sensing) circuit 30*a* located within connector 100 or any other connectors along cable(s) 10. Another embodiment of a reader 400 may be an output signal 2 monitoring device located somewhere along the cable line to which the connector 100 is attached. For example, a physical parameter status may be reported through signal processing circuitry in electrical communication with the center conductor (e.g., center conductor 601 of FIG. 6) of the cable 10. Then the reported status may be monitored by an individual or a computer-directed program at the cable-line head end to evaluate the reported physical parameter status and help maintain connection performance. The connector 100 may ascertain connection conditions and may transmit physical parameter status information or an electrical parameter of an electrical signal automatically at regulated time intervals, or may transmit information when polled from a central location, such as the head end (CMTS), via a network using existing technology such as modems, taps, and cable boxes. A reader 400 may be located on a satellite operable to transmit signals to a connector 100. Alternatively, service technicians could request a status report and read sensed or stored physical parameter status information (or electrical parameter information) onsite at or near a connection location, through wireless hand devices, such as a reader 400*b*, or by direct terminal connections with the connector 100, such as by a reader 400*a*. Moreover, a service technician could monitor connection performance via transmission over the cable line through other common coaxial communication implements such as taps, set tops, and boxes.

Operation of a connector 100 can be altered through transmitted input signals 5 from the network or by signals transmitted onsite near a connector 100 connection. For example, a service technician may transmit a wireless input signal 4 from a reader 400*b*, wherein the wireless input signal 4 includes a command operable to initiate or modify functionality of the connector 100. The command of the wireless input signal 4 may be a directive that triggers governing protocol of a control logic unit to execute particular logic operations that control connector 100 functionality. The service technician, for instance, may utilize the reader 400*b* to command the connector 100, through a wireless input component, to presently sense a connection condition related to current moisture presence, if any, of the connection. Thus the control logic unit 32 may communicate with sensor, which in turn may sense a moisture condition of the connection. The power harvesting (and parameter sensing) circuit 30*a* could then report a real-time physical parameter status related to moisture presence of the connection by dispatching an output signal 2 through an output component (e.g., the integrated circuit 504*b*) and back to the reader 400*b* located outside of the connector 100. The service technician, following receipt of the moisture monitoring report, could then transmit another input signal 4 communicating a command for the connector 100 to sense and report physical parameter status related to moisture content twice a day at regular intervals for the next six months. Later, an input signal 5 originating from the head end may be received through an input component in electrical communication with the center conductor contact 80 to modify the earlier command from the service technician. The later-received input signal 5 may include a command for the connector 100 to only report a physical parameter status pertaining to moisture once a day and then store the other moisture status report in memory 33 for a period of 20 days.

A coaxial cable connector connection system 1000 may include a reader 400 that is communicatively operable with devices other than a connector 100. The other devices may have greater memory storage capacity or processor capabilities than the connector 100 and may enhance communication of physical parameter status by the connector 100. For example, a reader 400 may also be configured to communicate with a coaxial communications device such as a receiving box 8. The receiving box 8, or other communications device, may include means for electromagnetic communication exchange with the reader 400. Moreover, the receiving box 8, may also include means for receiving and then processing and/or storing an output signal 2 from a connector 100, such as along a cable line. In a sense, the communications device, such as a receiving box 8, may be configured to function as a reader 400 being able to communicate with a connector 100. Hence, the reader-like communications device, such as a receiving box 8, can communicate with the connector 100 via transmissions received through an input component connected to the center conductor contact 80 of the connector. Additionally, embodiments of a reader-like device, such as a receiving box 8, may then communicate information received from a connector 100 to another reader 400. For instance, an output signal 2 may be transmitted from a connector 100 along a cable line to a reader-like receiving box 8 to which the connector is communicatively connected. Then the reader-like receiving box 8 may store physical parameter status information pertaining to the received output signal 2. Later a user may operate a reader 400 and communicate with the reader-like receiving box 8 sending a transmission 1002 to obtain stored physical parameter status information via a return transmission 1004.

Alternatively, a user may operate a reader 400 to command a reader-like device, such as a receiving box 8 communicatively connected to a connector 100, to further command the connector 100 to report a physical parameter status receivable by the reader-like receiving box 8 in the form of an output signal 2. Thus by sending a command transmission 1002 to the reader-like receiving box 8, a communicatively connected connector 100 may in turn provide an output signal 2 including physical parameter status information that may be forwarded by the reader-like receiving box 8 to the reader 400 via a transmission 1004. The coaxial communication device, such as a receiving box 8, may have an interface, such as an RF port 15, to which the connector 100 is coupled to form a connection therewith.

Referring to FIGS. 1-9 a conversion method is described. A coaxial cable connector 100 is provided. The coaxial cable connector 100 has a connector body 50 and a disk structure 40 located within the connector body 50. Moreover, a parameter sensing/processing (and power harvesting) circuit 30*b* that includes an embedded coupler device 515, sensors 560, and the integrated circuit 504*b* of FIG. 5A) is provided, wherein the parameter sensing/processing (and power harvesting) circuit 30*b* is housed within the disk structure 40. The parameter sensing/processing (and power harvesting) circuit 30*b* has an embedded metallic coupler device 515 configured to measure and/or harvest power from an RF signal flowing through the connector 100 when connected. Further physical parameter status ascertainment methodology includes connecting the connector 100 to an interface, such as RF port 15, of another connection device, such as a receiving box 8, to form a connection. Once the connection is formed, physical parameter status information applicable to the connection may be reported, via a signal processing circuit, to facilitate conveyance of the physical parameter status of the connection to a location outside of the connector body 50.

Figure 10:
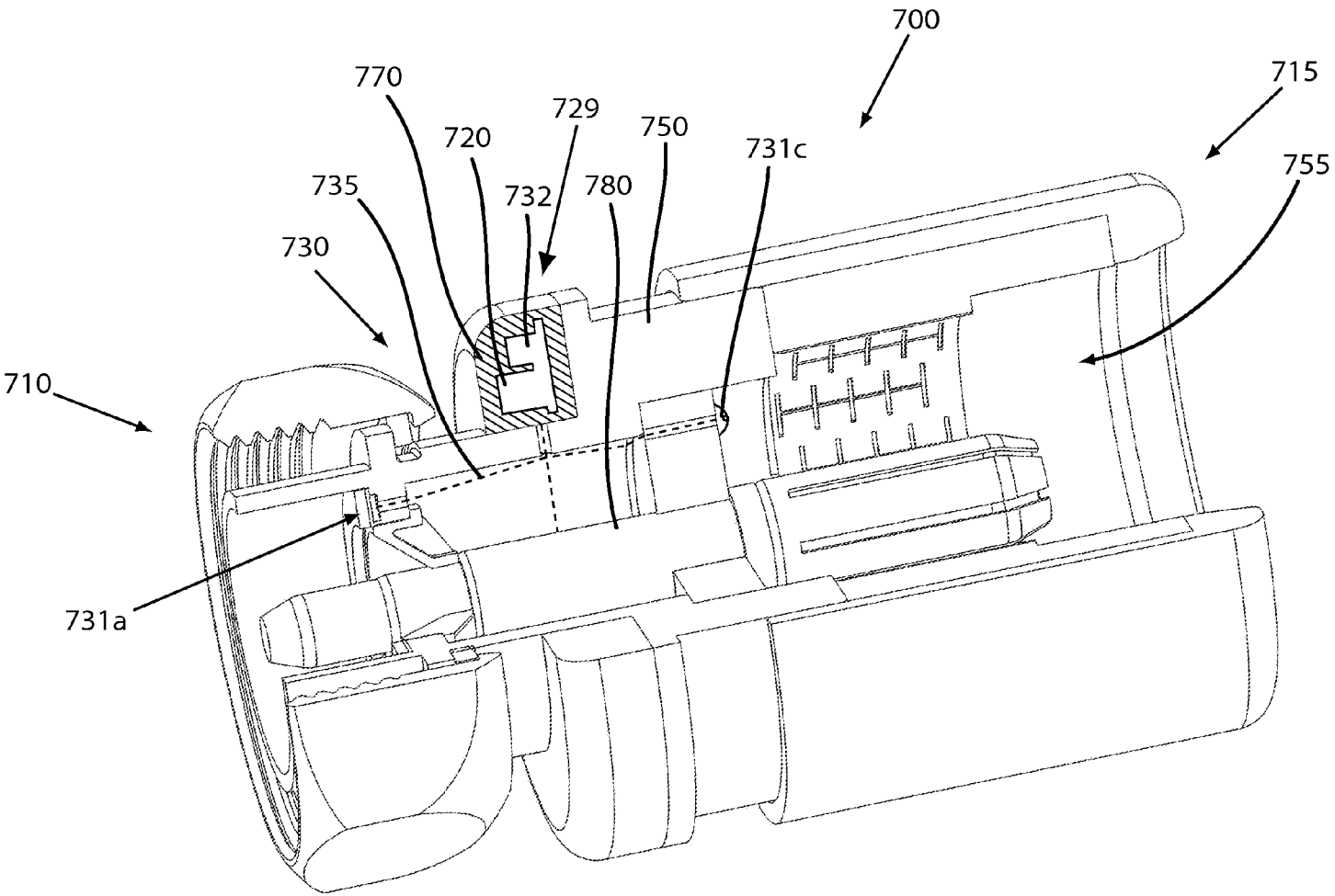
FIG. 10 depicts a side perspective cut-away view of another embodiment of a coaxial cable connector having multiple sensors, in accordance with the present invention.

Referring to the drawings, FIG. 10 depicts a side perspective cut-away view of an embodiment of a coaxial cable connector 700 having a coupler sensor 731*a* (e.g., the parameter sensing/processing (and power harvesting) circuit 30*b*) and a humidity sensor 731*c*. The connector 700 includes port connection end 710 and a cable connection end 715. In addition, the connector 700 includes sensing circuit 730*a* operable with the coupler sensor 731*a* and the humidity sensor or moisture sensor 731*c*. The coupler sensor 731*a* and the humidity sensor 731*c* may be connected to a processor control logic unit 732 operable with an output transmitter 720 through leads, traces, wires, or other electrical conduits depicted as dashed lines 735. The sensing circuit electrically links the coupler sensor 731*a* and the humidity sensor 731*c* to the processor control logic unit 732 and the output transmitter 729. For instance, the electrical conduits 735 may electrically tie various components, such as a processor control logic unit 732, sensors 731*a*, 731*c* and an inner conductor contact 780 together.

The processor control logic unit 732 and the output transmitter 720 may be housed within a weather-proof encasement 770 operable with a portion of the body 750 of the connector 700. The encasement 770 may be integral with the connector body portion 750 or may be separately joined thereto. The encasement 770 should be designed to protect the processor control logic unit 732 and the output transmitter 720 from potentially harmful or disruptive environmental conditions. The coupler sensor 731*a* and the humidity sensor 731*c* are connected via a sensing circuit 730*a* to the processor control logic unit 732 and the output transmitter 720.

The coupler sensor 731*a* is located at the port connection end 710 of the connector 700. When the connector 700 is mated to an interface port, such as port 15 shown in FIG. 9, a signal level of a signal (or samples of the signal) flowing through the connector 700 may be sensed by the coupler sensor 731*a*.

The humidity sensor 731*c* is located within a cavity 755 of the connector 700, wherein the cavity 755 extends from the cable connection end 715 of the connector 700. The moisture sensor 731*c* may be an impedance moisture sensor configured so that the presence of water vapor or liquid water that is in contact with the sensor 731*c* hinders a time-varying electric current flowing through the humidity sensor 731*c*. The humidity sensor 731*c* is in electrical communication with the processor control logic unit 732, which can read how much impedance is existent in the electrical communication. In addition, the humidity sensor 731*c* can be tuned so that the contact of the sensor with water vapor or liquid water, the greater the greater the measurable impedance. Thus, the humidity sensor 731*c* may detect a variable range or humidity and moisture presence corresponding to an associated range of impedance thereby. Accordingly, the humidity sensor 731*c* can detect the presence of humidity within the cavity 755 when a coaxial cable, such as cable 10 depicted in FIG. 9, is connected to the cable connection end 715 of the connector 700.

Power for the sensing circuit 730*a*, processor control unit 732, output transmitter 720, coupler sensor 731*a*, and/or the humidity sensor 731*c* of embodiments of the connector 700 depicted in FIG. 10 may be provided through electrical contact with the inner conductor contact 780 (using the aforementioned power harvesting process). For example, the electrical conduits 735 connected to the inner conductor contact 780 may facilitate the ability for various connector 700 components to draw power from the cable signal(s) passing through the inner connector contact 780. In addition, electrical conduits 735 may be formed and positioned so as to make contact with grounding components of the connector 700.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A structure comprising:

a sensing circuit mechanically connected to a disk structure located within a coaxial cable connector, wherein the sensing circuit is configured to sense parameters of the coaxial cable connector; and an integrated circuit mechanically and electrically connected to the disk structure and electrically connected to the sensing circuit, wherein the integrated circuit is positioned within the connector, wherein the integrated circuit is configured to receive parameter signals from the sensing circuit, wherein the parameter signals comprise analog voltages indicating the parameters of the coaxial cable connector, wherein the integrated circuit is configured to convert the parameter signals into digital data acquisition signal values readable by the integrated circuit, wherein the integrated circuit comprises an energy harvesting and power management circuit configured to receive an energy signal from an RF signal retrieved from an electrical signal flowing through the coaxial cable connector, and wherein the energy harvesting and power management circuit is configured to convert the energy signal into a regulated DC power supply voltage configured to provide power for operation for the integrated circuit.

2. The structure of claim 1, wherein the integrated circuit is configured to monitor a quality of a radio frequency (RF) signal flowing through the connector.

3. The structure of claim 2, wherein the sensing circuit is formed within the disk structure, wherein the integrated circuit is configured to receive said energy signal from the sensing circuit configured to retrieve the energy signal from the RF signal flowing through the coaxial cable connector.

4. The structure of claim 3, wherein the sensing circuit comprises a metallic structure formed within the disk structure.

5. The structure of claim 4, wherein the metallic structure comprises a first cylindrical structure and a second adjacent cylindrical extending from a bottom surface of the disk structure through a top surface of the disk structure, and wherein the first cylindrical structure in combination with the second cylindrical structure is configured to retrieve the energy signal from the RF signal flowing through the connector.

6. The structure of claim 5, wherein the sensing circuit is configured to sense a parameter of the RF signal, and wherein the parameter of the RF signal comprises an RF power level of the RF signal.

7. The structure of claim 1, wherein the integrated circuit is configured to report the digital data acquisition signal values to a computer processor at a location external to the connector.

8. The structure of claim 1, wherein the disk structure comprises a metallic signal path structure connected between the sensing circuit and the integrated circuit.

9. The structure of claim 1, wherein the integrated circuit is configured to communicate a status using a telemetry that is compatible with and transparent to a coaxial cable system comprising the coaxial cable connector.

10. The structure of claim 1, wherein sensing circuit is comprised by a transducer.

11. The structure of claim 1, wherein the sensing circuit comprises a sensor device configured to sense a condition of the connector when connected to an RF port, wherein the integrated circuit is configured to convert a signal indicating the condition into an additional digital data acquisition signal readable by a computer processor, and wherein the additional digital data acquisition signal comprises a DC voltage signal.

12. The structure of claim 11, wherein the sensor device comprises a sensor selected from the group consisting a mechanical connector tightness sensor for detecting mating forces of the connector when connected to the RF port, a relative humidity sensor, a capacitive sensor structure, an RF coupler structure, a temperature sensor, an optical/electric sensor, a resistance based sensor, and a strain connection tightness sensor for detecting mating forces of the connector when connected to the RF port.

13. The structure of claim 1, wherein the integrated circuit comprises an impedance matching circuit, an RF power sensing circuit, a multiplexer circuit, an analog to digital convertor circuit, and a digital control logic/clock generation circuit.

14. The structure of claim 1, wherein the disk structure comprises a faraday cage structure formed surrounding the integrated circuit, and wherein the faraday cage structure is configured to shield the integrated circuit from specified frequencies.

15. The structure of claim 1, wherein the integrated circuit stores a location address associated disk structure, and wherein the location address is configured to allow the disk structure to be queried from a remote data acquisition system.

16. A structure comprising:

a disk structure located within a coaxial cable connector; and an integrated circuit electrically and mechanically connected the disk structure, wherein the integrated circuit is positioned within the connector, wherein the integrated circuit is configured to receive parameter signals from a sensing circuit, wherein the parameter signals comprise analog voltages indicating parameters of the coaxial cable connector, wherein the integrated circuit is configured to convert the parameter signals into digital data acquisition signal values readable by the integrated circuit, wherein the integrated circuit comprises an energy harvesting and power management circuit configured to receive an energy signal from an RF signal retrieved from an electrical signal flowing through the coaxial cable connector, and wherein the energy harvesting and power management circuit is configured to convert the energy signal into a regulated DC power supply voltage configured to provide power for operation for the integrated circuit.

17. The structure of claim 16, wherein the integrated circuit is comprised by a semiconductor device.

18. A conversion method comprising:

providing a sensing circuit and an integrated circuit electrically and mechanically connected to a disk structure located within a coaxial cable connector, wherein the integrated circuit is electrically connected to the sensing circuit;

sensing, by the sensing circuit, parameters of the coaxial cable connector;

receiving, by the integrated circuit, parameter signals from the sensing circuit, wherein the parameter signals comprise analog voltages indicating the parameters of the coaxial cable connector; and converting, by the integrated circuit, the parameter signals into digital data acquisition signal values readable by the integrated circuit, wherein the integrated circuit comprises an energy harvesting and power management circuit;

receiving, by said energy harvesting and power management circuit, an energy signal from an RF signal retrieved from an electrical signal flowing through the coaxial cable connector; and converting, by the energy harvesting and power management circuit, the energy signal into a regulated DC power supply voltage configured to provide power for operation for the integrated circuit.

19. The method of claim 18, further comprising:

monitoring, by the integrated circuit, a quality of a radio frequency (RF) signal flowing through the connector.

20. The method of claim 19, further comprising:

receiving, by the semiconductor device, said power for operation from the sensing circuit.

21. The method of claim 18, wherein the sensing circuit comprises a metallic structure formed within the disk structure.

22. The method of claim 18, further comprising:

reporting, by the integrated circuit to a computer processor at a location external to the connector, the data acquisition signal.

23. The method of claim 18, wherein the integrated circuit is comprised by a semiconductor device.

24. The method of claim 18, wherein the sensing circuit comprises a sensor device, and wherein the method further comprises:

sensing, by the sensor device, a condition of the connector when connected to an RF port;

reporting, by the sensor device to the integrated circuit, a signal indicating the condition; and converting, by the integrated circuit, the signal indicating the condition into an additional data acquisition signal readable by a computer processor, wherein the additional data acquisition signal comprises a DC voltage signal.

25. The method of claim 18, wherein the disk structure comprises a faraday cage structure formed surrounding the integrated circuit, and wherein the method further comprises:

shielding, by the faraday cage, the integrated circuit from specified frequencies.

* * * * *